United States Patent [19]

Camp et al.

[11] 4,214,929

[45] Jul. 29, 1980

[54] LIQUID MONOPROPELLANTS CONTAINING DISSOLVED COMBUSTION MODIFIERS

[75] Inventors: Albert T. Camp, Welcome; Kurt F. Mueller; George W. Nauflett, both of Oxon Hill, all of Md.

[73] Assignee: The United States of America as represented by the Secretary of the Navy, Washington, D.C.

[21] Appl. No.: 559,186

[22] Filed: Mar. 14, 1975

[51] Int. Cl.[3] ..... C06B 43/00

[52] U.S. Cl. ..... 149/109.4; 60/217; 149/19.2; 149/19.93; 149/88; 149/93; 149/101; 149/105

[58] Field of Search ..... 60/217; 149/19.93, 38, 149/39, 44, 19.2, 88, 93, 101, 105, 109.4; 264/3 R

[56] References Cited

U.S. PATENT DOCUMENTS

| | | | |
|---|---|---|---|
| 3,447,983 | 6/1969 | Camp et al. | 264/3 R |
| 3,642,961 | 2/1972 | Sutphin et al. | 264/3 R |
| 3,870,578 | 3/1975 | Nichols | 264/3 R |

*Primary Examiner*—Leland A. Sebastian

*Attorney, Agent, or Firm*—R. S. Sciascia; A. L. Branning

[57] ABSTRACT

At least one combustion modifier is incorporated in liquid propellants by dissolving the modifier in at least one solvent such as alkoxypolyethylene glycol ether or a bis(alkoxypolyethylene glycol) formal to form a solution and mixing the resulting solution with the energetic component of the liquid propellant. Similar solutions of combustion modifier are also suitable for use as casting liquids in cast double-base propellants.

18 Claims, No Drawings

LIQUID MONOPROPELLANTS CONTAINING DISSOLVED COMBUSTION MODIFIERS

BACKGROUND OF THE INVENTION

This invention relates to explosive compositions and more specifically to liquid propellants and casting liquids used to manufacture solid propellants.

Homogeneity of a propellant and an explosive contributes both to their effectiveness and reliability. All components of a propellant and an explosive must be uniformly distributed therethrough to maximize effectiveness and reliability. However, owing to a variety of circumstances, homogeneity is difficult to achieve. This difficulty results in many complicated manufacturing steps in order to overcome the problem of achieving homogeneity, which adds to the danger of producing an explosive or a propellant.

It is generally understood in the explosive art that the term explosive is a generic term. A propellant is one type of explosive which is a composition designed to produce a large amount of gas as it deflagrates and provides thrust-in a rocket or gun, for example. A second type of explosive is a pyrotechnic which is a composition designed to produce visible smoke or flame. The third type of explosive is a secondary explosive which is a composition that generally provides blasting power. The fourth and last type of explosive is a primary explosive which generally serves to initiate the secondary explosive. In many instances, it is highly difficult to achieve the desired homogeneity in any of the four classes of the explosive.

Among the components of a propellant at least one combustion modifier is desirable. Especially suitable combustion modifiers are organo-lead and organo-copper salts or chelates. Yet in propellants, and especially liquid propellants, it is difficult to achieve the desired homogeneity when such combustion modifiers are used. For example, liquid nitrate ester-based monopropellants and casting liquids generally employ desensitizing liquids which would not homogeneously accommodate effective combustion aids such as lead and copper salts of organic acids or chelates of these metals. The combustion aids are not sufficiently soluble in the liquids used to form a liquid propellant-such as nitrate esters, and typical coolant liquids. The term "coolant liquid" refers to a desensitizing liquid which reduces the shock sensitivity of the energy containing ingredient of a propellant composition while at the same time reducing the energy content, and consequently the flame temperature of the energy containing ingredient. Typical of liquid propellants are Otto Fuel II which comprises propylene glycol dinitrate, dibutylsebacate and 2-nitrodiphenylamine; NOSET-A which comprises triethylene glycol dinitrate, dibutylsebacate and ethylcentralite; and other combinations of triethylene glycol dinitrate, metriol trinitrate, and a stabilizer. It is not feasible to include in these liquids known combustion modifiers such as organic salts of lead or copper because these combustion modifiers are not sufficiently soluble in the liquid propellant. Without the desired solubility, the combustion modifiers are not uniformly dispersible in the liquid propellant.

Some liquid monopropellants are also suitable for use as casting liquids which serve in molding or casting of propellants or explosives. The inability of the casting liquid to dissolve the combustion modifiers, such as the organic salts of lead or copper, prohibits the uniform distribution of the combustion modifiers unless difficult and dangerous process steps are added to insure such uniformity. Even with the additional process steps, the desired degree of uniformity is not always achieved. Thus, it is desirable that the casting liquids also dissolve the combustion modifiers.

A substantial number of liquids are known to be solvents for combustion modifiers such as the organic salts of lead and copper and form solutions of combustion modifiers. However, the use of these solutions of combustion modifiers creates more problems than it solves in the processing of liquid propellants or in the preparation of casting liquids. There are solutions which are neither compatible with the liquid propellant nor helpful to the propellant. For example, the solvents are not all miscible with the propellant. Lack of miscibility leads to nonuniformity of the propellant. Some solutions also reduce the thrust of the propellant undesirably. Other solutions render the propellant too sensitive or unstable for the desired use. Still other solutions render the propellant ineffective over the full range of operational conditions. Thus the problem becomes how to maintain specific thrust and low sensitivity while maintaining uniformity in liquid propellants and in liquids to be used for casting purposes.

SUMMARY OF THE INVENTION

Therefore, it is an object of this invention to provide an improved homogeneous liquid propellant.

Also it is an object of this invention to provide a liquid propellant having a combustion modifier homogeneously distributed therethrough.

It is a further object of this invention to provide a liquid propellant having maximized effectiveness.

It is a still further object of this invention to provide a liquid propellant having increased reliability.

Another object of this invention is to provide a liquid propellant which can be easily manufactured.

Yet another object of this invention is to provide an improved combustion modifier solution which is compatible with a liquid propellant.

Also it is an object of this invention to provide a solution to modify the catalytic effect within a liquid propellant.

It is a further object of this invention to provide an improved solution to simplify casting of propellants and explosives.

Also it is a further object of this invention to provide a solution having improved miscibility with a liquid propellant.

These and other objects of this invention are met by providing a composition comprising a solution wherein the solvent for the solution is at least one selected from the group consisting of a alkoxypolyethylene glycol ether and a bis alkoxy polyethylene glycol formal and the solute is at least one combustion modifier; and wherein the solution is used with a liquid propellant, or is suitable for use as a casting liquid for explosives or propellants.

DESCRIPTION OF THE PREFERRED EMBODIMENTS

It has now been discovered that an alkoxypolyethylene glycol ether, or bis(alkoxy polyethylene glycol)formal is a suitable solvent for dissolving a combustion modifier to form a solution suitable for mixing with a liquid propellant or for use as a casting liquid. When the solution is mixed with a liquid propellant such as di or tri-ethylene glycol dinitrate or propylene glycol dinitrate or is used as a casting liquid the combustion modifiers incorporated in the solution become uniformly dispersed in the liquid propellant, or uniformly dispersed in the cast explosive or propellant.

Thus, energetic liquid monopropellants and casting liquids for solid case propellants or explosives are improved by having incorporated therein the combustion aids. Uniform dispersal of the combustion aids is due to their solubility in the solvent. These combustion aids are usually organic salts or chelates of copper or lead.

Suitable solvents for dissolving the combustions aids should have certain other capabilities in addition to their qualities as a solvent. An appropriate solvent should be miscible with water in order to promote the ionization of the lead and copper salts in the solution and thereby enhance the electrical ignition of the entire monopropellant in the gun system. The solvent should also promote homogeneous distribution of the combustion aids in the solid cast propellant or explosive by being a solvent for the organic acid or chelate used to form the combustion modifiers. The solvent must be compatible with the liquid monopropellant in the presence of the dissolved modifier and thus provide a means for avoiding the problem of the insolubility of the organic salts or chelates of lead and copper in the liquid propellant.

Suitable solvents fall into two general classes. One class of solvent is a alkoxypolyethylene glycol ether exemplified by the dimethyoxytetraethylene glycol—especially sym-dimethoxytetraethylene glycol. The sym-dimethoxytetraethylene glycol has a structural formula of $$H_3C—OCH_2—CH_2—O—CH_2—CH—_2O—CH—_2—CH_2—OCH_2—CH_2—O—CH_3.$$

Another class of solvent is a bisalkoxy formal exemplified by bis[2(2-butoxy ethoxy ethyl)]formal or [(2-butoxy ethoxy ethyl) (2-methoxy ethoxy ethyl)]formal or bis[2(2-methoxyethoxy ethyl)]formal. Bis[2(2-butoxy ethoxy ethyl)]formal has a structural formula exemplified below where R is $—C_4H_9$, and bis[2(2-methoxy ethoxy ethyl)]formal has the exemplified formula where R is $CH_3$:

$$R—O—CH_2—CH_2—O—CH_2CH_2—O—CH—_2—O—CH_2CH_2OCH_2CH_2O—R$$

The solvent in which R is $—C_4H_9$ can be obtained as a result of purifying the reagent TP90B available from the Thiokol Corporation. The structure of [(2-butoxy ethoxy ethyl) (2-methoxy ethoxy ethyl)]formal is:

$$CH_3O—CH_2CH_2OCH_2CH_2O—CH_2—O—CH_2CH_2OCH_2CH_2OC_4H_9.$$

The lead and copper salts of organic acids which are used as combustion modifiers and are soluble in the above referenced solvents provide the desired results both in the liquid propellant and the casting liquid. Suitable salts include but are not limited to lead beta resorcylate, copper beta resorcylate, lead salicylate, copper salicylate, lead 2-ethyl hexoate, copper 2-ethyl hexoate, lead 5-tertiary butyl salicylate, and lead 5-methylene disalicylate. By forming solutions of these salts with the solvents specified above prior to the incorporation of the salts into the liquid propellant or casting liquid the problems of the substantial insolubility of the salts in the energetic portion of the liquid propellant and the non-homogeneous distribution of the salts in the cast propellant or explosive are solved.

Because of the salt solubility and the solvent compatibility, the resultant solution mixes well with liquid propellants and is also an effective casting liquid. Suitable liquid propellants with which the solution may be mixed include Otto Fuel II and NOSET-A as above-described. Other liquids with which the solution is combinable include triethyleneglycol dinitrate, diethyleneglycoldinitrate, nitroglycerin, 1,2,4-butane triol trinitrate (BTTN), erythritolnitrates, sorbitol nitrates, metriol-trinitrate and pentaerythritol trinitrate. Liquid nitrate ester monopropellant compositions such as those described in U.S. Pat. No. 3,634,158 to Camp et al are also useful with solutions of this invention.

In the following examples which are intended to illustrate without unduly limiting the invention, all parts and percentages are by weight unless otherwise specified.

EXAMPLE I

A liquid monopropellant suitable for use in Naval or military cannon and torpedo propulsion systems is formulated by dissolving 100 grams of normal lead betaresorcylate in 500 grams of a solution of bis[methoxy ethoxy ethyl]formal containing 0.25 grams of 2-nitrodiphenylamine as an antioxidant. To this solution is added 9.4 kilograms of triethylene glycol dinitrate stabilized with 0.25% of symmetrical diethyl diphenyl urea. This complete homogenous propellant is dried under vacuum so that the resultant product contains less then 0.05% water. When burned in a calorimeter under 25 atmospheres of helium, a sample produced a calorimetric output of 785 calories per gram. This value is competitive with that of typical single-base, service-accepted solid, gun propellants used by the U.S. Army and Navy.

The composition shows a better thermal stability in the 110° C. Taliani test under nitrogen atmosphere than typical solid gun propellants based on nitrocellulose. In the well-known "Surveillance" test of 45-gram samples stored in glass-stoppered bottles at 65.5° C., brown fumes of $N_2O_4$ do not appear after more than 500 days of storage. Safety tests of this composition show it to be a Class B shipping hazard (not mass-detonating), and a Class 2 military hazard (fire hazard only).

This composition has the advantages over other liquid gun propellant candidates of being easier to ignite in a gun chamber without being an ignition hazard at atmospheric pressure. It burns very cleanly in guns and test bombs, leaving no carbonaceous residue and producing minimal muzzle flash.

This monopropellant has extremely low volatility and hence is non-toxic under ordinary handling conditions. No respirator or skin protection is required for handling. It has an essentially neutral pH value and is non-corrosive to typical materials of construction. It is compatible with seals and adhesives typically used in guns and torpedo propulsion systems. It does not crystallize upon cooling to minus 40° F., and is sufficiently fluid to be pumped or injected at minus 20° F. It is safe to handle at temperatures up to 240° F. and does not autoignite for at least five hours at 275° F.

EXAMPLE II

A casting liquid containing dissolved ballistic modifiers of known efficacy in double-base rocket propellants is prepared as follows: 200 grams of normal lead betaresorcylate, 100 grams of 2-nitro diphenylamine, and 50 grams of normal cupric bataresorcylate are dissolved in 2,150 grams of bis[methoxy ethoxy ethyl]formal. To this solution is added 7.5 kilograms of purified nitroglycerin to complete the casting liquid. This liquid is thereafter deaerated and dried under vacuum at 75° F. with a slow sparge of nitrogen gas admitted through a tube extending to the bottom of the vacuum desiccator. The liquid is then ready for introduction into base-grain casting powder of suitable composition to provide the desired finished solid propellant.

The advantages of this casting liquid over prior art are as follows:

1. It provides for more nearly homogeneous distribution of the ballistic modifiers by (a) introducing an appropriate portion of them into the interstitial regions among the granules of base grain and (b) dissolving any similar undissolved ballistic modifiers which were incorporated via the base grain.

2. It allows for ballistic adjustment of base-grain that previously yielded out-of-specification cast propellants.

3. In accomplishing 1 and 2 it provides a smoother burning surface, allowing for greater ballistic predictability and reproducibility.

EXAMPLE III

A liquid monopropellant suitable for use in military guns and torpedo propulsion systems is formulated by dissolving 100 grams of normal lead betaresorcylate in 500 grams of a solution of bis[butoxy ethoxy ethyl]formal containing 0.25 gram of 2-nitrodiphenylamine as an anti-oxidant. To this solution is added 9.4 kilograms of triethylene glycol dinitrate stabilized with 0.25% of symmetrical diethyl diphenyl urea. This complete homogeneous propellant is dried under vacuum at room temperature to contain less than 0.05% water.

When burned in a calorimeter under 25 atmospheres of helium, a sample produces a calorimetric output of 773 cal/g. This value, though somewhat lower than that of Example I is still adequate for many propellant applications. This composition has an advantage over Example I in that the bis(butoxyethoxyethyl)formal is nearly insoluble in water.

This monopropellant exhibited excellent stability in both the 110° C. Taliani test under nitrogen atmosphere and at 65.5° C. under air. Safety tests show it to be a Class B shipping hazard and Class 2 military hazard.

Ignition properties under pressure are acceptable for the intended military applications and burning is clean. Other storage and handling properties show the material to be safe and acceptable for Ordnance use.

Obviously numerous modifications and variations of the present invention are possible in light of the above teachings. It is therefore to be understood that, within the scope of the appended claims the invention may be practiced otherwise than as specifically described.

What is claimed as new and desired to be secured by Letters Patent of the United States is:

1. In a liquid propellant having at least one ballistic modifier therein, the improvement comprising a substantially single phase solution of the liquid propellant and a combustion modifier solution wherein the ballistic modifier is dissolved in at least one solvent selected from the group consisting of an alkoxypolyethyleneglycol ether and a bis alkoxy formal.

2. The liquid propellant of claim 1 wherein the alkoxypolyethyleneglycol is dimethoxy tetraethylene glycol.

3. The liquid propellant of claim 1, wherein the bisalkoxyformal is Bis[2(2-butoxy ethyl)]formal.

4. The liquid propellant of claim 1 wherein the bis alkoxy formal is Bis[2-(2-methoxy ethoxy ethyl)]formal.

5. The propellant of claim 1 wherein the combustion modifier is selected from the group consisting of lead betaresorcylate, copper betaresorcylate, lead salicylate, copper salicylate, lead 2-ethyl hexoate, copper 2-ethyl hexoate, lead 5-tertiary butyl salicylate and lead 5-methylene disalicylate.

6. The propellant of claim 5 wherein the bisalkoxypolyethylene glycol is dimethoxytetraethyleneglycol.

7. The propellant of claim 5 wherein the bisalkoxy formal is Bis[2(2-butoxy ethoxy ethyl)]formal.

8. The propellant of claim 5 wherein the bisalkoxy formal is Bis[2(2-methoxyethoxyethyl)]formal.

9. A solution comprising (a) at least one solvent selected from the group consisting of a alkoxypolyethylene glycol ether and a bisalkoxy formal, and (b) a combustion modifier.

10. The solution of claim 9 wherein the alkoxypolyethylene glycol ether is dimethoxytetramethylene glycol.

11. The solution of claim 9 wherein the bis alkoxy formal is Bis[2(2-butoxyethoxyethyl)]formal.

12. The solution of claim 9 wherein the bisalkoxy formal is Bis[2(2-methoxy ethoxyethyl)]formal.

13. The solution of claim 9 wherein the combustion modifier is at least one selected from the group consisting of copper betaresorcylate, lead betaresorcylate, copper salicylate, lead salicylate, copper 2-ethyl hexoate, lead 2-ethyl hexoate, lead 5-tertiary butyl salicylate, and lead 5-methylene disalicylate.

14. The solution of claim 14 wherein the alkoxypolyethylene glycol ether is dimethoxytetraethylene glycol.

15. The solution of claim 14 wherein the bisalkoxy formal is Bis[2(-butoxyethoxyethyl)]formal.

16. The solution of claim 14 wherein the bisalkoxy formal is Bis[2(2-methoxy ethoxyethyl)]formal.

17. The solution of claim 9 wherein the solution is a casting liquid for compositions selected from the group consisting of an explosive and a propellant.

18. The solution of claim 9 wherein the combustion modifier is present in an amount sufficient to give a saturated solution.

* * * * *